US008656642B2

(12) United States Patent
Boens

(10) Patent No.: US 8,656,642 B2
(45) Date of Patent: Feb. 25, 2014

(54) SAFETY DOOR AND DOORFRAME ASSEMBLY

(75) Inventor: Clifton N. Boens, Chicago, IL (US)

(73) Assignee: Safety Door International, LLC, Tyrone, GA (US)

( * ) Notice: Subject to any disclaimer, the term of this patent is extended or adjusted under 35 U.S.C. 154(b) by 0 days.

(21) Appl. No.: 13/066,988

(22) Filed: Apr. 30, 2011

(65) Prior Publication Data

US 2011/0203179 A1 Aug. 25, 2011

(51) Int. Cl.
*E05D 15/48* (2006.01)

(52) U.S. Cl.
USPC ..... 49/170

(58) Field of Classification Search
USPC ..... 49/70, 163, 170, 171, 388, 460, 462
See application file for complete search history.

(56) References Cited

U.S. PATENT DOCUMENTS

| | | | |
|---|---|---|---|
| 2,184,259 | A | 12/1939 | Seaman |
| 3,086,383 | A | 4/1963 | Scott |
| 3,141,204 | A | 7/1964 | Wheeler |
| 3,827,183 | A | 8/1974 | Zimmerman et al. |
| 3,934,371 | A | 1/1976 | Ulatowski et al. |
| 4,261,140 | A | 4/1981 | McClean |
| 4,290,233 | A | 9/1981 | Hubbard |
| 4,999,949 | A | 3/1991 | Grandlund |
| 5,076,017 | A | 12/1991 | Jacobs |
| 5,092,077 | A | 3/1992 | Teinturier-Milgram |
| 5,765,311 | A | 6/1998 | Kapler |
| 6,141,909 | A | 11/2000 | Hanson |
| 6,185,871 | B1 | 2/2001 | Wang |
| 6,311,432 | B1 | 11/2001 | Watson |
| 6,434,888 | B1 | 8/2002 | Shaw et al. |
| 6,832,450 | B1 | 12/2004 | Shaharbani |
| 7,047,694 | B2 | 5/2006 | Salzman |
| 7,234,202 | B2 | 6/2007 | Li |
| 7,293,328 | B2 | 11/2007 | Endres |
| 2002/0046501 | A1 | 4/2002 | Webb |
| 2002/0157319 | A1 | 10/2002 | Haq |
| 2005/0108946 | A1 | 5/2005 | Shaharbani |
| 2005/0183342 | A1 | 8/2005 | Holden |

*Primary Examiner* — Jerry Redman

(74) *Attorney, Agent, or Firm* — J. T. Hollin, Attorney at Law, P.C.

(57) ABSTRACT

Disclosed is a door assembly comprising a custom-built doorframe housing a main door which carries an integrally mounted, rectangularly-shaped leaf door. The trailing edge of the main door rotates about a vertical axis which is parallel to, and proximate the inner rear surface of the doorframe. The leaf door is rotatably attached, by a spring mechanism, to a cutout excised from the leading edge of the main door. As the main door rotates about its vertical axis, the leaf door is restrained, by tension of the spring mechanism, from closing with full force upon human fingers or any other object that may be proximate the door jamb, or inner doorframe area. The pivoting, or trailing edge of the main door may be abutted against elastomeric material affixed to the inner rear surface of the doorframe, thereby preventing the insertion of fingers into what otherwise would be a hazardous gap.

12 Claims, 9 Drawing Sheets

SAFETY DOOR AND DOORFRAME ASSEMBLY

CROSS-REFERENCES TO RELATED APPLICATIONS AND PRIORITY CLAIM

This application claims the benefit of provisional patent application No. 61/008,027, filed on Dec. 18, 2007, and further claims the benefit of non-provisional application Ser. No. 12/316,631 filed on Dec. 15, 2008. The content, disclosures, and descriptions in each of these applications are incorporated herein by reference.

STATEMENT REGARDING FEDERALLY SPONSORED RESEARCH OR DEVELOPMENT

Not applicable.

NAMES OF THE PARTIES TO A JOINT RESEARCH AGREEMENT

There is no joint research agreement in conjunction with this invention.

REFERENCE TO A "SEQUENCE LISTING," A TABLE, OR A COMPUTER PROGRAM LISTING APPENDIX

Not applicable.

BACKGROUND OF THE INVENTION (1) Field of the Invention

This inventive concept is directed toward enhancing safety in residences and commercial establishments where the possibility of injury exists due to fingers of children or adults being caught in door closings. Each year approximately 30,000 people, both children and adults are rushed to hospital emergency rooms in the United States because they have accidentally crushed or amputated a finger. The two most common causative factors in severe finger injuries are (1) the use of power tools and (2) closing of doors. According to the National Center for Injury Prevention and Control (NCIPC) in Atlanta, Ga., children aged 4 and younger and men aged 55 and older are the two age groups found to be most at risk for these type injuries. It is estimated that over 1500 door-caused finger injuries are so severe that the injured person requires reconstructive surgery. Fifty-five percent of these accidents occur at home. Car doors and garage doors are also included in these statistics, along with finger injuries caused by revolving doors.

There have been several types of finger guards or door guards marketed, the most common being some type of flexible blocking device attached to the vertical edge of the latching side of a door to prevent it from closing fully. Other devices include concepts such as "gate for doors," which is an actual gate used in doorways, hallways, and at the top of stairs in order to prevent toddlers from going past a certain point or playfully opening or closing a co-located door. Practically all of these inventions are designed and marketed for the protection of children, but not specifically for adults, who are taller and heavier.

Door guards, which are also known as hinge guards, anti-finger trapping devices, and/or finger guards, protect fingers in door hinges. A closing door can exert up to 40 tons per square inch of pressure between the hinges. Door guards normally cover the gap which exposes the hinges as a door is opened. The most common form of door guard is a length of rubber or other resilient material that attaches either to the trailing edge of a door, or to both the door and the frame, and is flexible enough to cover the hinged gap should the door be fully opened.

(2) Description of the Related Art

The prior art contains a number of door guards and protective devices, either for the hinged trailing edge or the latching, (leading) edge of a door. One notable example is in U.S. Pat. No. 2,184,259, where disclosures similar to embodiments of this invention are made. In particular, there is disclosed the design of a concave frame shape to accommodate the convex end of a door which pivots about a vertical axis defined by upper and lower pins. However, no claims to the safety features of this invention were made.

U.S. Pat. No. 3,141,204 has a uniquely designed door jamb in which the side frame member has transversely movable or flexible pressure plates which will yield in the event an object such as a finger is caught between the edge of a closing door and the side frame.

Several devices are designed to provide a protective shield or covering over the gap in the area of the door hinges when a door is opened. For example, U.S. Pat. No. 4,261,140 features a flexible, retractable shield overlying the front, or outward gap of the hinged area, and a flexible shield overlying the rear or inward gap at the door. This invention also features a door stop device mounted to the front surface of the door which, as the door is moved toward closed, said device is activated to drop into position and block the door from closing, thereby providing protection against injury which might occur between the leading edge of the door and the jamb.

U.S. Pat. No. 4,290,233 features a "detachable finger protector for continuously closing the gap formed between the heel of the door and the abutting adjacent jamb surface whenever the door is opened." This patent also provides for a device to cover and enclose the hinges of the door by a finger protecting safety shield.

An elongated safety hinge which is extended horizontally outward from the door jamb is the primary feature of U.S. Pat. No. 5,076,017. Further, a resilient end cap is secured to the "swing" edge of the door in order to minimize the risk of fingers being injured if caught between the door stile and the door jamb. The invention also discloses latching rods extending from the upper and lower extremities of the door.

U.S. Pat. No. 5,092,077 utilizes a variable geometry semi-rigid piece to attach to both the hinged vertical edge of the door and the door jamb. This provides finger protection in the hinged area along the length of the door.

The gap between the hinge portion of a door and the door edge is protected by an elongated finger door guard device which automatically covers the hazardous gap when the door is opened in U.S. Pat. No. 5,765,311. A similar device is used in U.S. Pat. No. 6,141,909.

U.S. Pat. No. 6,311,432 has a unique safety device designed to be fitted to the side of a door stile adjacent to the jamb, which device serves to sweep the zone between the jamb and the adjacent stile as the door is pivoted closed. The door jamb is also fitted with a pair of vertically extending shielding strips, serving to form a blocked safety area as the door swings into the closing zone.

U.S. Pat. Nos. 6,434,888, 6,832,450, and 7,047,694 all have similar elongated hinge area door guards.

BRIEF SUMMARY OF THE INVENTION

Several unique features of this inventive concept evidence the fact that safety and ease of operation are coordinated throughout the design. The basic invention is a door assembly comprised of a main door, which can be of a variety of sizes and materials, a four-sided doorframe for housing the main door via a major pivotal means, and a leaf door, attached to the leading edge of the main door by a minor pivotal means. A further developed embodiment of the inventive concept includes a resilient padding which fills the exposed gap along the pivotal side (or trailing edge) of the main door.

An elongated rectangular portion of the leading edge of the main door is excised and the section of the main door where the cutout is made is reinforced to support a pivoting function of the leaf door. The leaf door is a virtual miniature door designed to rotate, upon its own minor pivotal means, which may be an adequately tensioned spring mechanism. The pivotal axis of the leaf door is vertically oriented and parallel to the leading edge of the main door. The leaf door normally remains flush with the main door, unless it is impeded by an object inserted at the inside front doorframe, in which event, the leaf door is forced open slightly, thereby negating the full impact of the closing force on the object. The primary object of all the embodiments of this inventive concept is to produce a door that minimizes the danger of the fingers of a child, adult, or a small pet being (1) crushed between the leading edge of the main door and the doorframe, or (2) severely injured in the gap in the vicinity of what normally would be the hinged area, or trailing edge of a door.

Several embodiments of the door assembly concept may feature a main door with a rounded or concave surface the entirety of the trailing edge. With such trailing edge, an axle or concentric upper and lower dowels form the major pivotal means.

One aspect of the door assembly is the ability to latch the leaf door into the threshold of the doorframe as a security measure when the main door is fully closed. In a different embodiment, the main door cutout contains a lower ledge which can accommodate the latching of the leaf door, again as a security provision. When unlatched, the leaf door may rotate approximately 20 to 30 degrees by virtue of its minor pivotal means.

INDEX TO COMPONENTS OF BASIC DOOR ASSEMBLY

1. Main Door
2. Upper Main Spindle
3. Lower Main Spindle
4. Main Spindles Rotational Axis
5. Circular Upper Housing
6. Circular Lower Housing
7. Main Door Cutout
8. Door Knob
9. Dual Action Deadbolt
10. Direction of Movement of Main Door
11. Threshold of Doorframe
12. Doorframe Exterior Exposure
13. Doorframe
14. Entry Side of Frame
15. Leaf Door
15(*a*) Leading edge of leaf door
16. Leaf Door Upper Dowel
17. Leaf Door Lower Dowel
18. Leaf Door Pivotal Axis
19. Leaf Door Upper Circular Notch
20. Leaf Door Lower Circular Notch
21. Leaf Door Security Rod
22. Range of Movement of Leaf Door
23. Side Strike Box
24. Lower Strike Box
25. Spring Mechanism for Leaf Door
26. Vertical Deadbolt Pin
27. Horizontal Deadbolt Pin
28. Interior Surface of Main Door
29. Exterior Surface of Main Door
30. Resilient Padding
31. Trailing Edge of Main Door
31(*a*) Top Surface of Main Door
32. Leading Edge of Main Door
32(*a*) Bottom Surface of Main Door
33. Upper Reinforced Ledge
34. Lower Reinforced Ledge
35. Receptacle for Security Rod
36. Lower Strike Box
37. Retracting Spring
38. Strike Plate
39. Upper Ball Bearing Assembly
40. Lower Ball Bearing Assembly
41. Revolving Wing
42. Wing Leaf Door
43. Power-Driven Shaft
44. Upper Dowel
45. Lower dowel
46. Upper Circular Metallic Notch
47. Lower Circular Metallic Notch
48. Spring Loading Device
48(*a*) Not applicable
49. Wing Upper Ledge
50. Wing Lower Ledge
51. Revolving Door
52. Doorframe Inner Top Surface
53. Doorframe Outer Top Surface
54. Doorframe Inner Rear Surface
55. Doorframe Outer Rear Surface
56. Doorframe Top Threshold
57. Doorframe Bottom Threshold
58. Doorframe Inner Front Surface
59. Doorframe Outer Front Surface
60. "U"-Spring Mechanism

BRIEF DESCRIPTION OF THE VIEWS OF THE DRAWINGS

FIG. 11(*a*) is a top cutaway view showing the main axle-door and doorframe support element, as seen from the cutaway line B-B.

DETAILED DESCRIPTION OF THE INVENTION

Figure 2:
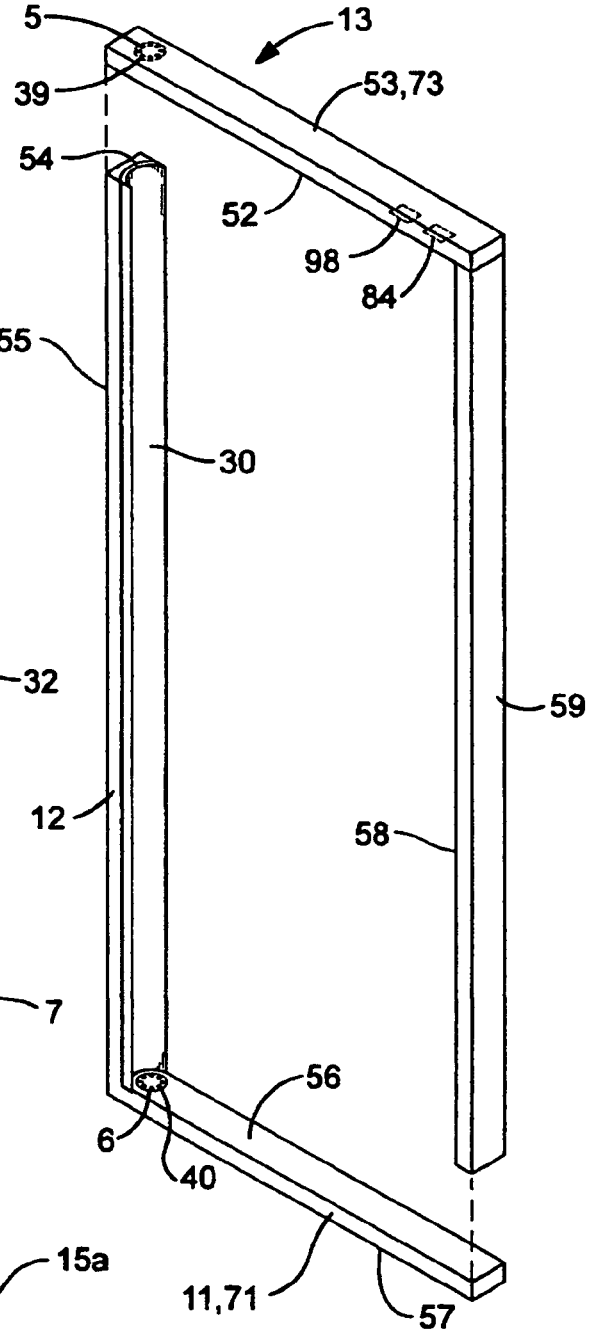
FIG. 2 is a semi-exploded view of the doorframe, including the locations of supporting ball bearing assemblies.

Initially, it is necessary to clarify the principle terms and phrases used in referring to or describing the function of this inventive concept. The term "doorframe" 13 means a generally rectangular-shaped assemblage comprising four oblong panels which have been joined together. These four panels consist of eight surfaces, which are more precisely depicted by reference to FIG. 2. Proceeding in a clockwise fashion, the doorframe 13 is described as follows:

(1) a first panel comprising a vertically-oriented oblong structure having a flat outer rear surface 55 and a concave inner rear surface 54;

(2) a second panel comprising a horizontally-oriented oblong structure having a flat outer top surface 53 and a flat inner top surface 52;

(3) a third panel comprising a vertically-oriented oblong structure having a flat outer front surface 59 and a flat inner front surface 58; and (4) a fourth panel comprising a horizontally-oriented oblong structure having a flat bottom threshold 57 and flat top threshold 56.

The endmost parts of each of the foregoing panels are joined orthogonally, as illustrated, so that their inner surfaces form four inner corners, or junctions. The interior perimeter of the doorframe consists of a dimension approximately equal to the total exterior perimetral dimension of the main door. A further design feature of the door assembly includes a resilient padding 30 which may be attached to the entire surface of the concave inner rear surface 54 of the doorframe.

As further clarification of the features of the door assembly, the term "leading edge," as applicable to either the main door or the leaf door, means that portion of the door which, when closed, abuts the doorframe inner front surface. The term, "trailing edge" means that portion of the surface of either the main door or the leaf door which contains or is attached to the major pivotal means or the minor pivotal means, respectively. When the main door 1, 61 is fully closed within the doorframe 13, the leading edge of the main door abuts the doorframe inner front surface 58, the top surface (horizontally-oriented) of the main door 1, 61 abuts the doorframe inner top surface 52, and the bottom surface (horizontally-oriented) of the main door 1, 61 abuts the doorframe top threshold 56.

Figure 1:
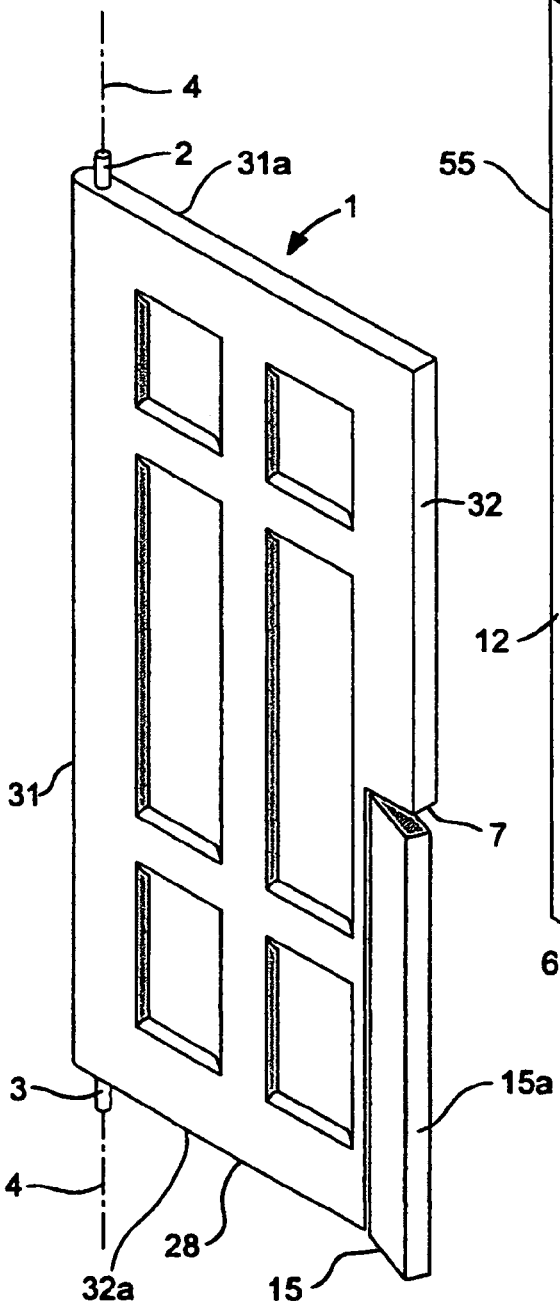
FIG. 1 presents a simplified view of the main door and a generic leaf door attached to the lower front quarter of the main door.

A generalized view and summation of the operation of this inventive concept can be presented, beginning with FIG. 1. There is shown a perspective view of a generic "main door" 1, including a rectangular cutout 7, said cutout 7 precisely sized to accommodate the leaf door 15. The cutout is further defined by a "horizontal segment" and a "vertical segment." Moving to FIG. 2, there is illustrated an exploded view of the doorframe 13. The threshold of the door frame 11, doorframe inner rear surface 54, outer top surface of door frame 53, upper strike box 83, strike plate 98, and the location of upper and lower ball bearing assemblies, 39, 40, respectively, are shown.

FIG. 1 also depicts major pivotal means comprised of an upper main spindle 2 and a lower main spindle 3, which define the main spindles rotational axis 4 about which the main door 1 revolves. A semi-compacted material, forming a resilient padding 30, traverses the length of the doorframe inner rear surface 54, said resilient padding 30 filling the gap which is normally exposed at the hinged area of a standard door. The resilient padding 30 is attached to the doorframe inner rear surface 54 by an adhesive or other suitable means. The resilient padding 30 serves to prevent the insertion of fingers in the space between the trailing edge 31 of the main door 1 and the doorframe inner rear surface 54.

Although not shown in FIG. 1, the bottom surface 32(*a*) of the main door 1 and the doorframe top threshold 56 may be overlaid with a layer of grooved hard rubber material. The hard rubber material may be applied to the bottom surface 32(*a*) of the main door 1 and the doorframe top threshold 56 such that the small grooves of the hard rubber material will run lengthwise and parallel along both surfaces. Thereby, the grooves are relatively interlocking with each other when the main door 1 is closed. This feature will further serve as a weather-tight barrier against the elements.

The doorframe features a built-in circular upper housing 5. The circular upper housing 5 is structured so as to contain a ball bearing assembly designed to accept the upper main spindle 2. An appropriate ball bearing assembly may be comprised of spindle bearings or any other type of bearings particularly suitable for both rotational guidance of a shaft, and exhibiting a moderate capacity for radial load bearing. The doorframe inner top surface 52 and doorframe outer top surface 53 are shown in a more advanced embodiment of the inventive concept, as detailed in FIG. 3 and FIG. 4 herein.

Figures 9, 9A, 9B:
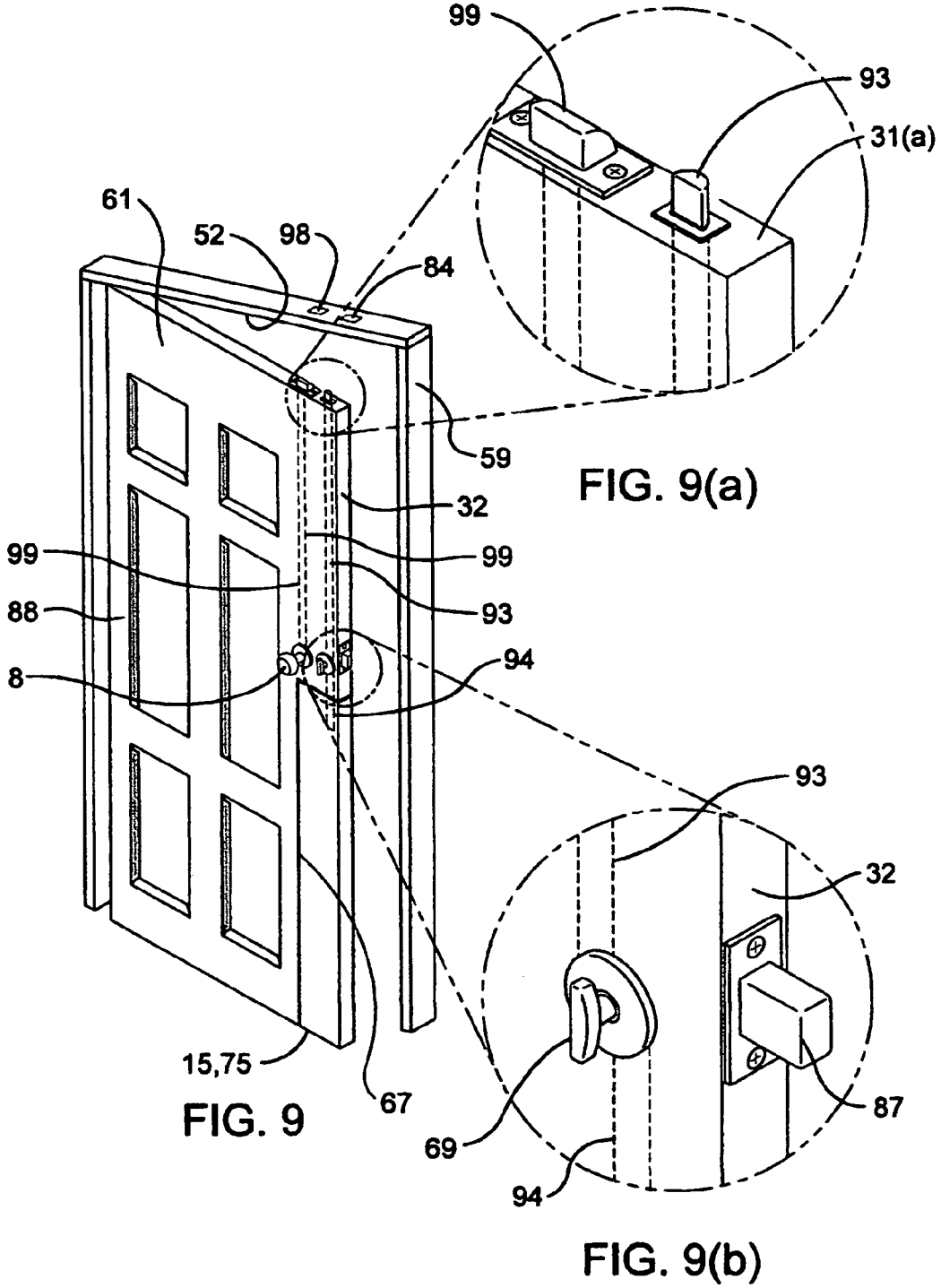
FIGS. 9, 9(*a*), and 9(*b*) show a perspective rendering of the latching mechanisms associated with an enhanced main door, including two vertical security rods, and a dual-action deadbolt.

In order to describe a practical operating system for the door assembly, including latching of the main door 1 and leaf door 15, the reader is now referred to FIGS. 9, 9(*a*), and 9(*b*). This set of drawings illustrates an enhanced main door 61 along with compatible latching mechanisms.

In viewing FIGS. 9, 9(*a*), and 9(*b*), enhancements to the basic embodiment of the door assembly are shown. The following is a supplemental index to components of the enhanced main door 61 and other advanced embodiments of the basic door assembly:

61. Enhanced Main Door
62. Upper Main Spindle
63. Lower Main Spindle
64. Main Spindles Rotational Axis
65. Circular Upper Housing
66. Circular Lower Housing
67. Main Door Cutout
68. Door Knob
69. Latching Deadbolt
70. Direction of Movement of Main Door
71. Frame Threshold
72. Concave Mounting Side of Frame
73. Top of Frame
74. Entry Side of Frame
75. Leaf Door
76. Leaf Door Upper Dowel
77. Leaf Door Lower Dowel
78. Leaf Door Pivotal Axis
79. Upper Ball Bearing Assembly
80. Lower Ball Bearing Assembly

81. Tubular Housing
82. Left Mechanical Linkage
83. Right Mechanical Linkage
84. Upper Strike Box
85. Spring Mechanism for Leaf Door
86. Vertical Deadbolt Pin
87. Horizontal Deadbolt Pin
88. Interior Surface of Main Door
89. Exterior Surface of Main Door
90. Resilient Curtain/Padding
91. Convex Trailing Edge of Door
92. Leading Edge, Main Door
93. Upper Security Rod
94. Middle Security Rod
95. Lower Security Rod
96. Lower Strike Box
97. Retraction Spring
98. Strike Plate
99. Main Latching Rod
100. Doorframe Inner Curvature
101. Main Axle-Door
102. Upper Spindle
103. Lower Spindle
104. Casing
105. Bolt
106. Threaded Shaft
107. Doorframe Support Element
108. Axle
109. Inner Angle
110. Open Position
111. Coil
112. Spring Rod
113. Prong
114. Mounting Plate
115. Leading Edge of Leaf Door
116. Trailing Edge of Leaf Door
117. Top of Leaf Door
118. Bottom of Leaf Door The embodiment of the door assembly shown in FIGS. 9, 9(*a*), and 9(*b*) operates in much the same manner as the basic embodiment. The most noticeable modification in the enhanced embodiment as shown, is the inclusion of an upper security rod 93, a middle security rod 94, a lower security rod 95, and a dual action latching deadbolt 9, 69. With the enhanced main door 61 shown partially open, as in FIG. 9, the upper 93, middle 94, and lower security rod 95 are all indicated by dashed lines. In the operating embodiment of the door assembly, metal tubes, slightly larger in diameter than the aforementioned security rods will enclose the entire length of each the upper, middle, and lower security rods 93, 94, and 95.

As we view FIGS. 9, 9(*a*), and 9(*b*), security latching mechanisms applicable to the enhanced main door 61 are presented. The leaf door (either 15 or 75) may be latched to the main door 1, 61, by means of the latching deadbolt 69. The dual action deadbolt 69 is connected to an upper security rod 93, a middle security rod 94, and a horizontal deadbolt pin 87. For further clarification, FIG. 10 also presents close-up views of the functioning of these components. When the latching deadbolt 69 is turned to its "latched" position, it will simultaneously move the middle security rod 94 downward, forcing the lower security rod 95 (also referred to as the leaf door security rod 21 in the basic embodiment) into a lower strike box 96. The lower strike box 96 (shown in FIG. 5 and FIG. 10) is built into the frame threshold 11, 71 to provide an extra measure of security and leaf door stability. This turning of the latching deadbolt 9, 69 also simultaneously pushes the horizontal deadbolt pin 87 into a side strike box 23 (not shown) built into the doorframe inner front surface 58.

To secure the upper portion of the enhanced main door 61, a main latching rod 99, operated by an industry standard doorknob 8, 68 is shown in FIG. 9. The upper end of the main latching rod 99 is shown in FIG. 9(*a*), extending above the top surface 31(*a*) of the enhanced main door 61. This is the normal operational position of the main latching rod 99, whether the enhanced main door 61 is open or closed. As the enhanced main door 61 is pushed to the closed position, the upper end of the main latching rod 99 engages a strike plate 98. The door knob 8, 68 controls the operation of the main latching rod 99 in a manner comparable to the spindle of a conventional doorknob operating a horizontally-oriented deadbolt in a doorknob and strike plate combination.

Figure 10:
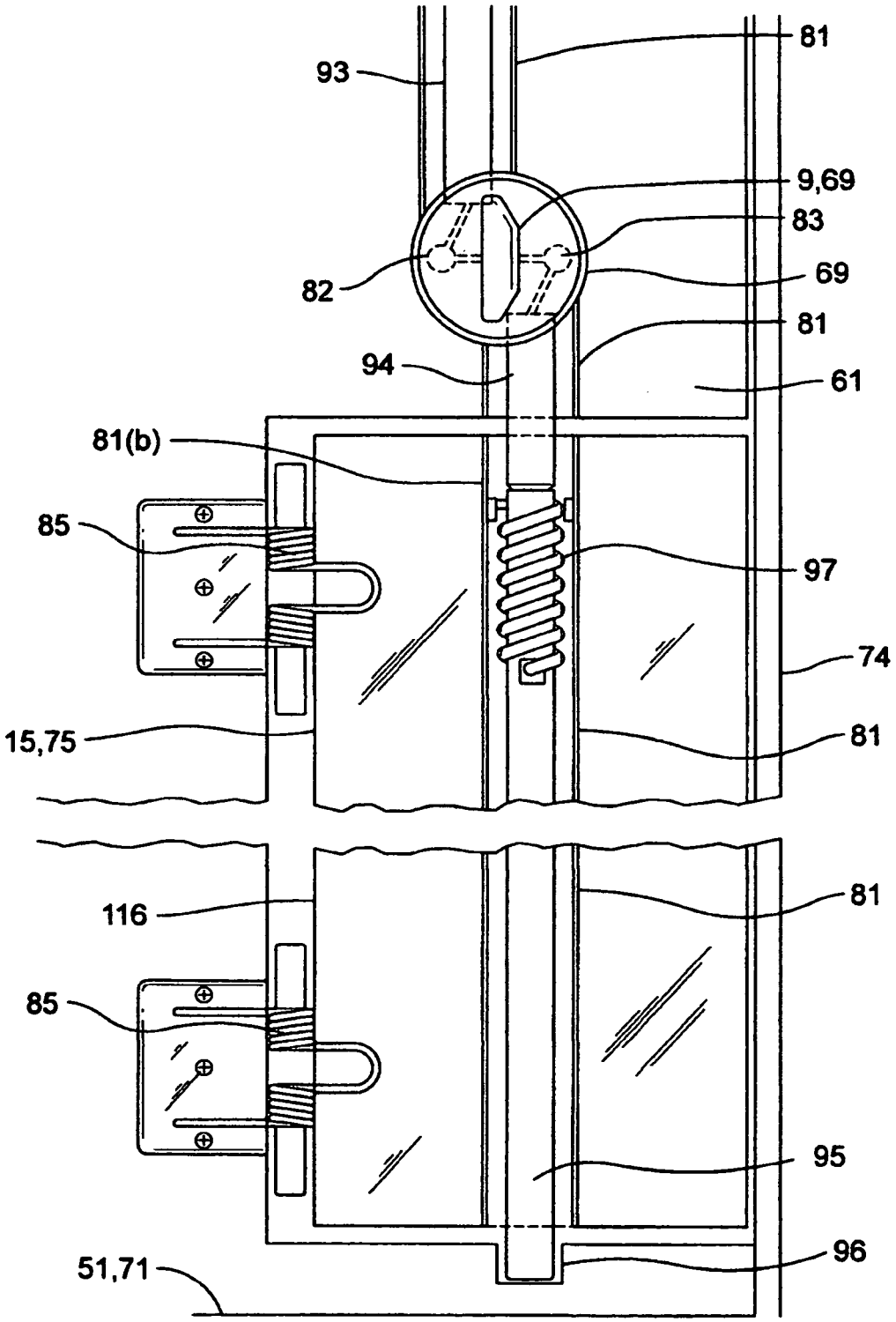
FIG. 10 is a cutaway view depicting the operation of the upper, middle, and lower security rods.

To further illustrate the functioning of the upper security rod 93 and the lower security rod 95, we may refer to FIG. 10. The upper security rod 93 and the lower security rod 95 are both shown extended into their "latched" positions by virtue of operation of the latching deadbolt 9, 69. However, the enhanced main door 61 may only be latched for security purposes when the door is fully closed. After closing the enhanced main door 61, the latching deadbolt 69 is rotated clockwise, causing mechanical linkages 82, 83 connected to the upper security rod 93 and the lower security rod 95, respectively, to be displaced. Movement of the mechanical linkages 82, 83 forces the upper security rod 93 upward into the upper strike box 84 (shown in FIG. 9), and the lower security rod 95 into its lower strike box 96.

Figure 3:
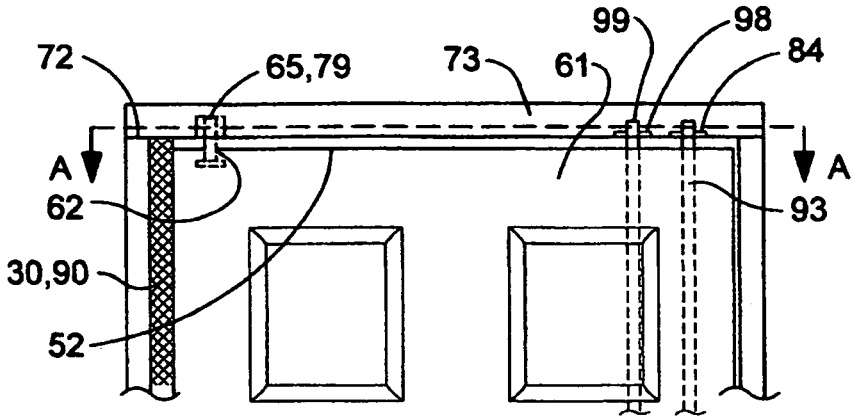
FIG. 3 is a side view of the top portion of the door assembly, showing the upper ball bearing assembly, strike plate, and the upper strike box.

In viewing FIG. 3, there is depicted a rendering of a side view of the upper segment of the door assembly with the enhanced main door 61 in the closed position. Both the main latching rod 99 and the upper security rod 93 are latched into the strike plate 98 and the upper strike box 84, respectively. The bottom end of the upper main spindle 62 is shown as anchored into the enhanced main door 61. The main door's upper circular housing 65 is shown as it fits into the top of the frame 73. The upper circular housing 65 housing also contains an upper ball bearing assembly 79 which supports and guides the radial motion of the upper main spindle 62.

Figure 4:
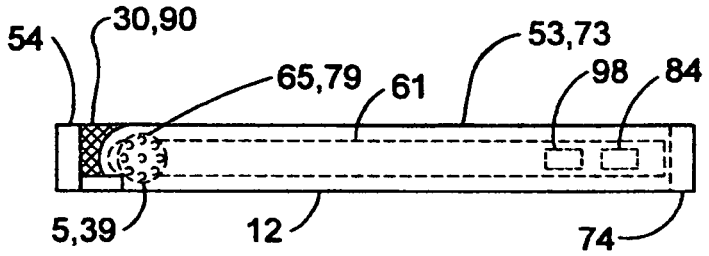
FIG. 4 is a view looking downward through the top of the doorframe and observing the enhanced main door, further depicting the upper ball bearing assembly.

FIG. 4 illustrates a view of the door assembly looking downward through either the top of the doorframe 73, or the doorframe outer top surface 53, as depicted by cross-sectional line A-A. The main door 1, or enhanced main door 61, is shown closed. Observing the leftmost portion of FIG. 3, the padding 30, 90 adhering to the doorframe inner rear surface 54 is depicted. The circular upper housing 5, 65, which contains the upper ball bearing assembly 39, is also shown.

Figure 5:
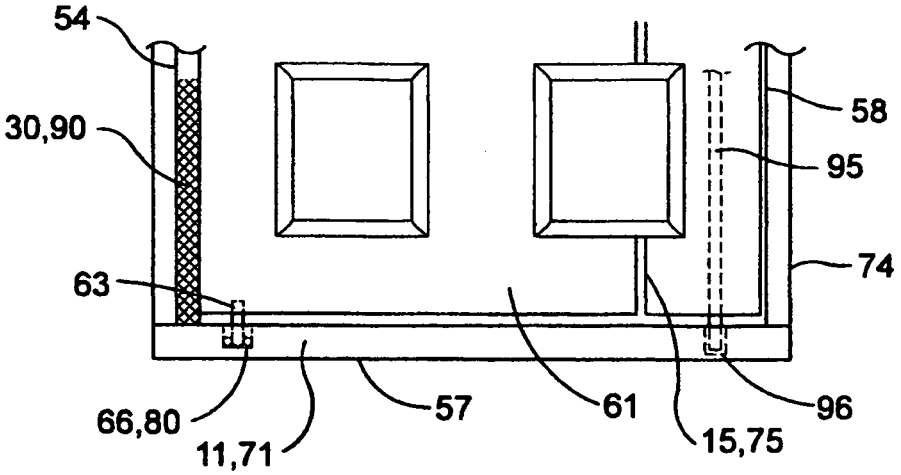
FIG. 5 gives a side view of the lower segment of the door assembly, indicating positions of the circular lower housing, lower ball bearing assembly, and the lower security rod.

In viewing FIG. 5, the lower segment of the door assembly is shown. The circular lower housing 66 is shown as it is embedded in the doorframe threshold 11, 71. The circular lower housing 66 contains the lower ball bearing assembly 80. The lower ball bearing assembly provides load support for the enhanced main door 61, radial stability for the lower main spindle 63, and a relatively friction-free rotational platform for the lower main spindle 63. The lower security rod 95 is depicted as being inserted into the lower strike box 96, thus providing a secure latching condition for the enhanced main door 61.

Continuing in the examination of FIG. 5, it is seen that the leftmost portion of the threshold 11 is constructed with a built-in circular lower housing 66. This housing contains a customized ball bearing assembly 80 designed to accept the lower main spindle 63 and also support the weight and rotation of the enhanced main door 61. An appropriate ball bearing assembly 80 may be comprised of any of a selection of axial spherical roller bearings, axial cylindrical roller bearings, or axial deep groove ball bearings. Each of these species of ball bearing assemblies has high load carrying capacity, excellent durability, and is suitable for guiding the lower main spindle 63.

Figure 6A:
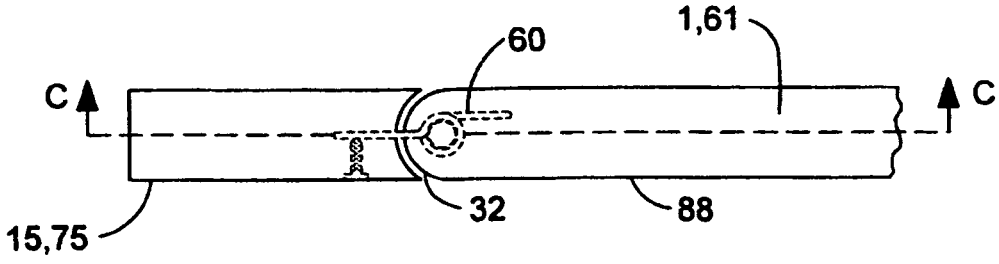
FIG. 6 presents a view of a pair of "U" spring mechanisms which may be utilized to operate the leaf door.
Figure 6:
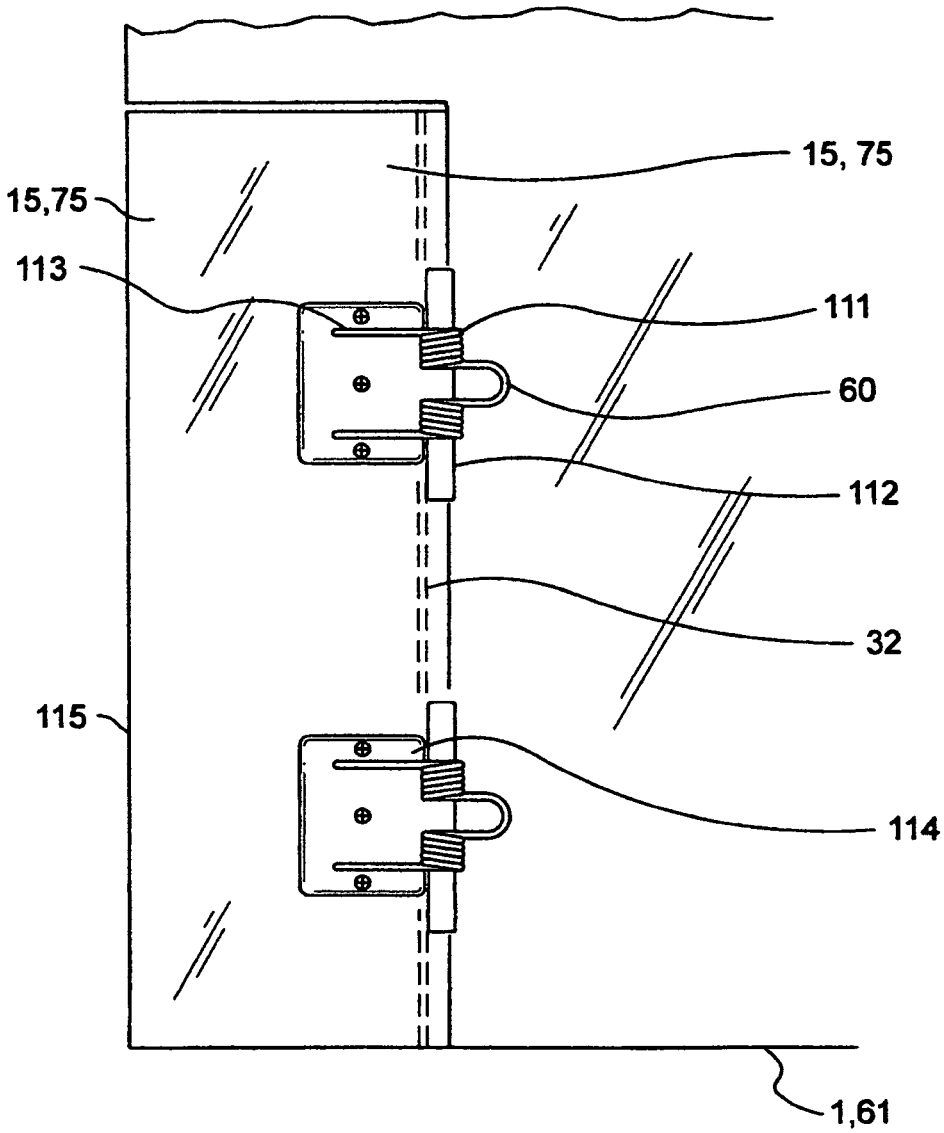

FIG. 6 presents a pair of "U" springs 60 that are of practical consideration for use in the operation of the leaf door 15, 75. The coil 111 of each of the U-springs 60 is partially welded to a vertical spring rod 112 which is affixed to a recess within the rounded leading edge 32 of the main door 1, 61. The extended prongs 113 of each U-spring 60 are in turn welded to a mounting plate 114 which is attached by appropriate means to the leaf door 15, 75.

Figure 7:
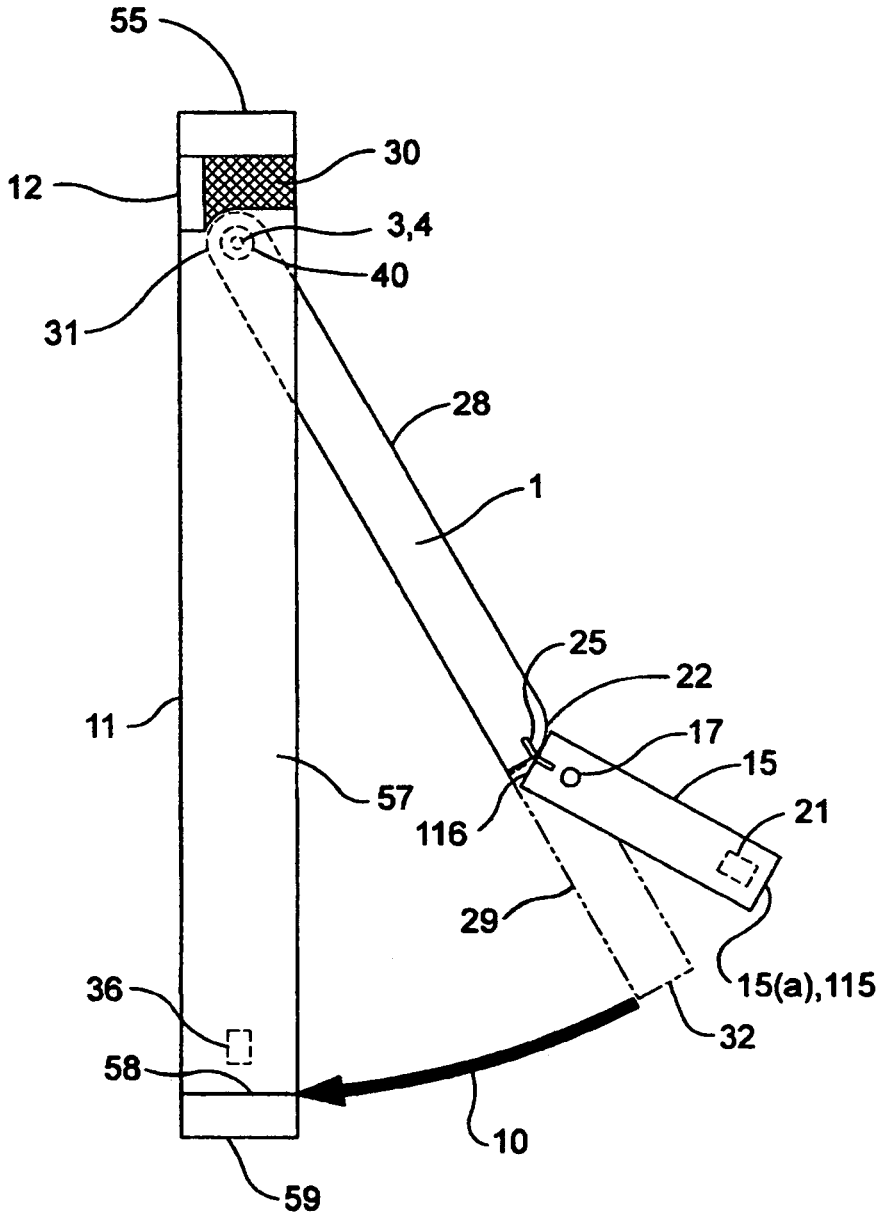
FIG. 7 is an illustration of a view looking upward through the threshold with the main door partly open and the leaf door unlatched from its normal flush relationship with the main door.

FIG. 7 illustrates the coordinated operation of the leading edge 32, of the main door, the main door 1, and the leaf door 15, as seen looking from the floor upwards through the doorframe bottom threshold 57. The main door 1 is shown partly open. The leaf door 15 is illustrated with the leaf door security rod 21 unlatched, and for demonstrative purposes only, the leaf door 15 is shown lagging slightly behind its normal position of flush alignment with the main door 1. The resilient padding 30 is shown compressed toward the trailing edge of the main door 31. The main door 1 has been opened by pushing it about its rotational axis 4, the lower line of said axis extending coaxially through the lower main spindle 3 and the circular lower housing 6 (not shown).

When the main door 1 is pushed closed, in the direction of its arc of movement 10, the leaf door 15 also travels in its normally flush relationship with the main door 1. Once the main door 1 is fully closed the leaf door 15 may then be latched by a turn of the dual action latching deadbolt 9 (not shown) pushing the leaf door security rod 21 downward into its fitted receptacle 36, which is located in the threshold 11. These operations are more fully depicted in FIG. 8.

FIG. 7 also serves to demonstrate that the leaf door 15 provides protection against accidental crushing of, for example, a finger which may be accidentally caught between the leading edge of the main door 32 and the inner front surface 58 of the doorframe. As the main door 1 closes, the leaf door 15 makes blunted contact with the finger. As the contact takes place, it will be with substantially reduced force since the spring mechanism 25 does not permit the leaf door 15 to contact the inner front surface 58 of the doorframe with the same rigidity as the main door 1. In fact, the main door 61 may continue its travel to become fully flush with the doorframe inner front surface 58. Thus, the leaf door 15 has prevented serious injury. Assuming normal door operation, and not contact having been made, once the main door 1 is fully closed, the leaf door 15 may then be secured by operation of the dual action dead bolt lock 9 as it moves the leaf door security rod 21 downward.

Figure 8:
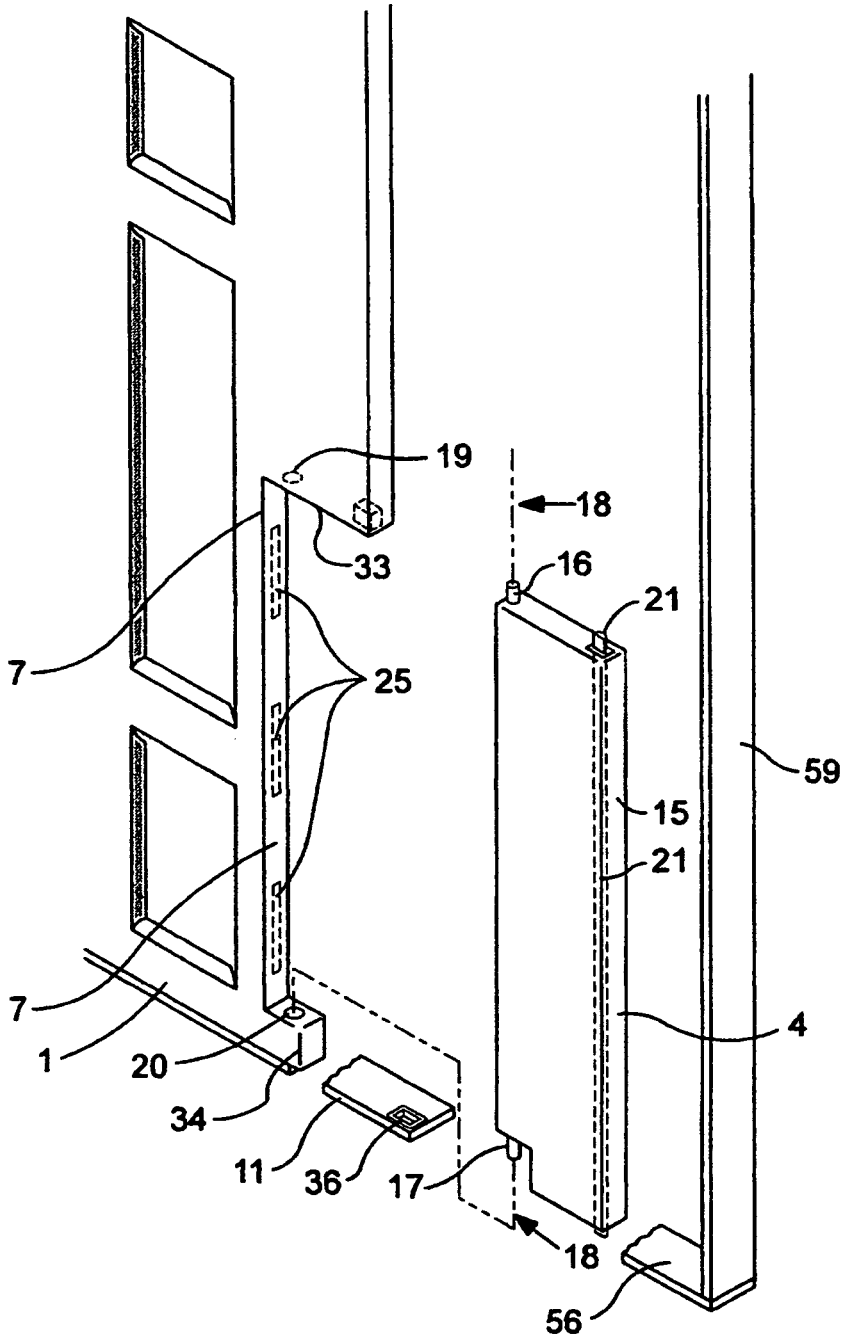
FIG. 8 is a rendering of an embodiment wherein the leaf door revolves upon a lower ledge of the main door.

As we move to FIG. 8, an alternative embodiment of the leaf door 15 is shown, along with a different method of attachment to the main door 1. The embodiment in FIG. 8 depicts an a mechanical arrangement whereby the leaf door 15 is mounted between an upper reinforced ledge 33 and a lower reinforced ledge 34 within the main door cutout 7. For clarity, the leaf door 15 is shown separated from its junction with the main door 1. As a means of security, a leaf door latch (not shown) may be used to operate, in a vertical orientation, an internal leaf door security rod 21 which snugly fits into a lower strike box 36 within the doorframe threshold 11 when the leaf door 15 is closed flush with the main door.

Also pictured in FIG. 8 is a leaf door upper circular notch 19, which is built into the upper portion of the main door cutout 7 so as to provide both a form-fitted recess and rotational stability for the leaf door upper dowel 16. The leaf door lower circular notch 20 is cut into the main door lower reinforced ledge 34 and serves to accommodate and provide rotational stability for the leaf door lower dowel 17. As the leaf door 15 is operated to and from the latched and/or unlatched positions, it pivots about its pivotal axis 18, which axis is defined by the co-located centerlines of the upper and lower circular notches 19, 20.

FIG. 8 shows an effective location of one or more spring mechanisms 25 for retention of the leaf door 15, which is a position firmly affixed to mid-length of the main door cutout 7. It is anticipated that a number of variations of spring means will prove to be effective as the inventive concept is modified. Another possible spring mechanism 25 includes the use of matching upper and lower helical torsion springs. One end of the upper helical torsion spring affixed to the upper circular notch 19 and one end of the lower helical torsion spring affixed to the lower circular notch 20 of the leaf door 15. The remaining end of each respective helical torsion spring will be attached at a point on the leaf door 15 so as make the axis of each helical torsion spring co-located with the pivotal axis 18 of the leaf door 15.

FIG. 10 presents a closer view of the operation of the upper and lower security rods 93, 95. Shown is a cutaway view of the relevant portions of the enhanced main door 61 and the leaf door 75 with both the upper and lower security rods 93, 95 in the latched position. The upper security rod 93 and the lower security rod 95 are each enclosed in similar tubular housings 81, to guide their vertical movement within the enhanced main door 61. The latching deadbolt 69 is pictured as having been turned clockwise to its vertical position. This action has caused the left mechanical linkage 82 to move the upper security rod 93 into the upper strike box 84 (not shown). This position of the latching deadbolt 69 has also caused the right mechanical linkage 83 to move a middle security rod 94 downward against the lower security rod 95, thereby forcing the lower security rod 95 into the lower strike box 96. The latched position of the latching deadbolt 69 has also places the retraction spring 97 into tension, which, in turn, forces the lower security rod 95 to remain inserted into the lower strike box 96.

Upon turning the latching deadbolt 69 counter-clockwise to its horizontal unlatched position, the left mechanical linkage 82 retracts the upper security rod 93 from the upper strike box 84 and causes the rod 93 to be stowed within the enhanced main door 61. Simultaneously, the right mechanical linkage 83 retracts the middle security bolt 94 upward, which relieves the downward pressure on the lower security rod 95. Thereupon, the retraction spring 97 compresses and pulls the lower security rod 95 out of the lower strike box 96. The leaf door 15, 75 is then free to pivot in its injury-preventing mode with the normal closing of the main door 1, 61.

Other Embodiments and Applications of the Door Assembly

Again referring to FIG. 1, a number of modifications and additions to the basic door assembly can be projected. For instance, a different embodiment of this invention would entail increasing the relative size of the leaf door 15 by extending its length vertically so as to encompass all, or a portion of, the leading edge of the main door 1 above the door knob or handle. The increased size of the leaf door 15 may require a series of spring mechanisms 25 in order to provide sufficient tension, symmetry, and balance to properly position the leaf door 15 throughout the operating range of the enhanced main door 1.

Referring again to FIG. 8, it must be noted that, although not shown in the present embodiments, design features may be incorporated whereby both the upper circular housing 65 and the lower circular housing 66 are constructed with a "quick release" feature built into the frame which feature will allow an effective means of removal of either housing for lubrication of the components or replacement of the ball bearing assemblies 79, 80.

A variety of spring means 25 (FIG. 2.) may be incorporated into the different embodiments of this inventive concept. One type of spring mechanism consists of a continuous spring-loaded hinge, similar to a piano hinge. This hinge runs the entire length of the pivoting edge of the leaf door 15 and thus serves to define the leaf door pivotal axis 18. A second possible type of spring is the commonly used auto-locking bifold spring which also can operate effectively in this invention when it is appropriately attached to both the enhanced main door 61 and the leaf door 15.

As another consideration for effective functioning of the invention, manufacture of the door assembly may be enhanced by incorporating miniature spring-loaded cabinet hinges or Euro-hinges as the spring mechanism 25 in the design of the leaf door 15. As further consideration, FIG. 6 presents a combination of two "U"-springs connecting the leaf door 15 and the enhanced main door 61

A further improvement to this inventive concept comprises the application of an optimum thickness of rubberized or plastic-type material along the entire leading edge 32 of the main door and also application of the same material along the entry side of the doorframe 14. Such material further serves the primary object of the invention, which is to minimize the possibility of serious injury in the event a finger is caught between the leaf door 15 and the entry side of the doorframe 14.

Embodiment

Door Assembly with Integral Axle

Figure 11A:
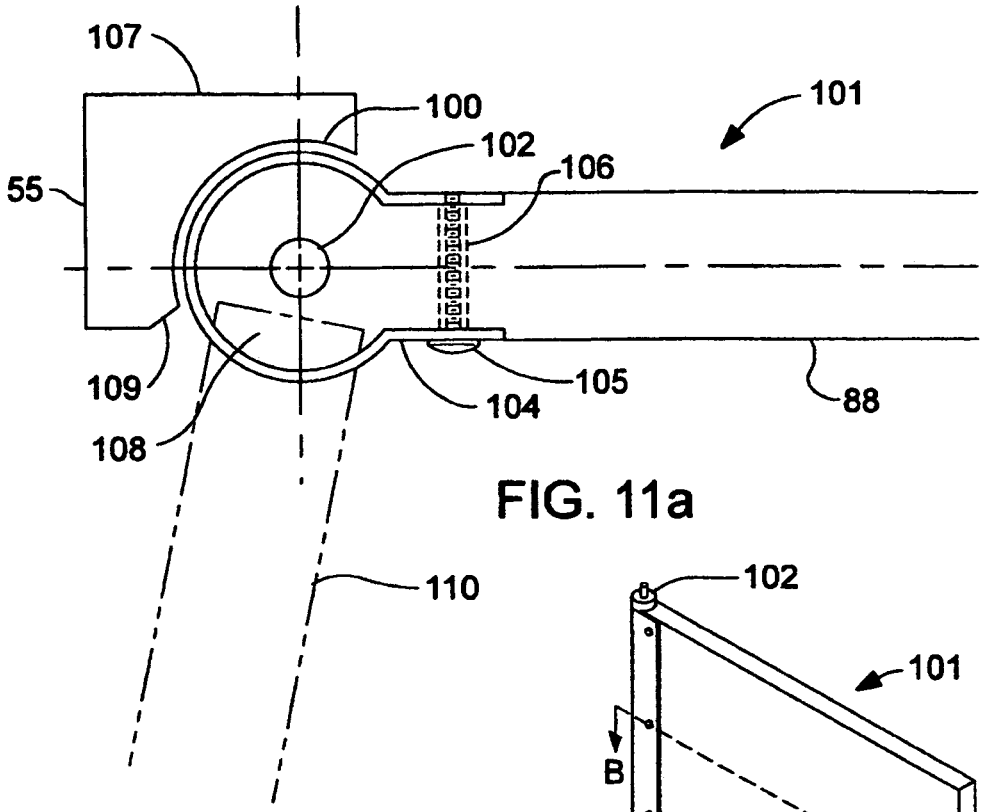
FIG. 11 presents an embodiment of a main "axle-door" in which the door contains upper and lower spindles which are embedded in, and co-axially aligned with, a rigid vertical rod, referred to as an "axle."
Figure 11:
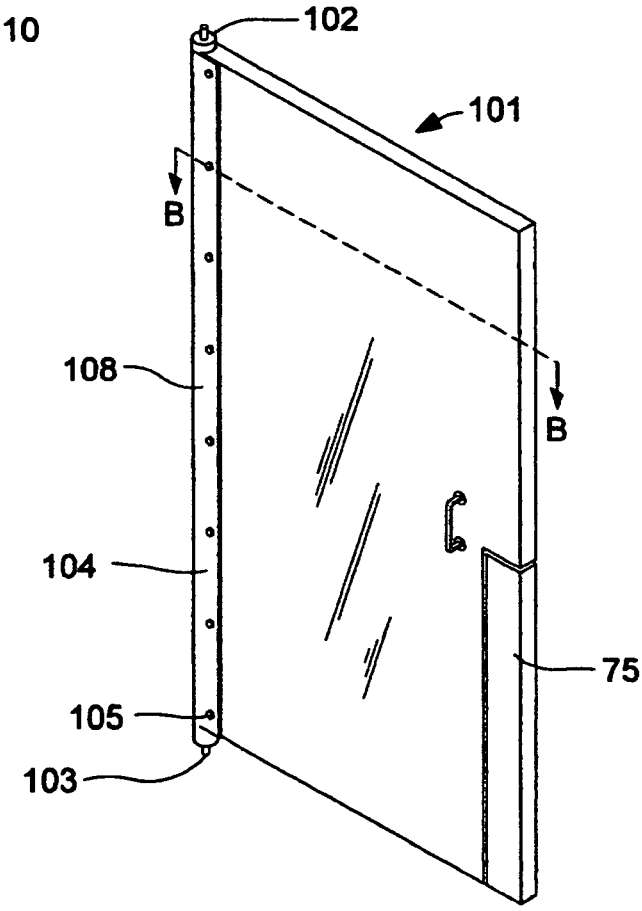

In referring to FIG. 11, an embodiment of this inventive concept is shown with a major pivotal means comprising a main axle-door 101 constructed with an integral door axle 108 and the previously disclosed leaf door 75. The door axle 108 is of a diameter slightly larger than the main axle-door 101 thickness and additionally has embedded in it, at opposite ends, a spindle 102 and lower spindle 103 of the main axle-door 101. The door axle 108 is of sufficient strength and rigidity as to provide a durable and steady axis for opening and closing of the main axle-door 101. Owing to the increased diameter of the door axle 108 relative to the thickness of the main axle-door 101, a variable-shaped doorframe 107 is required to support the pivotal functioning of the main axle-door 101, in which the inner back surface of the previously disclosed doorframe is modified. A top view of the cross-section of such modified inner back surface is shown in FIG. 11. The door axle 108 may further be tightly enclosed in a casing 104, composed of metal or other suitable material. The casing 104 may be press-fitted against the door axle 108 or secured with bolts 105 along the length of the main axle-door 101. The casing enhances endurance, security, and all-weather protection.

In viewing FIG. 11(*a*), a top view of the main axle-door 101 and variable-shaped doorframe 107 is presented. The upper spindle 102 and a portion of the main axle-door 101 are shown in the door closed position. The dashed lines indicate the position of the main axle-door 101 were it fully opened 110. In the fully open position 110 sufficient clearance from the doorframe support element 107 is provided by a beveled angle 109, which allows sufficient room for pivoting of the main axle-door 101.

It can be seen that, as the main axle-door 101 revolves open or closed, the door axle 108 rotates in close proximity to the inner curvature 100 of the doorframe support element 107. This close spacing between the main door axle 108 and the inner curvature 100 of the doorframe support element 107 serves a critical safety function in that the close tolerance prevents the insertion of a finger into what would normally have been the gapped hinged area of a conventional door.

Office and/or Commercial Embodiment

Figures 12, 12A:
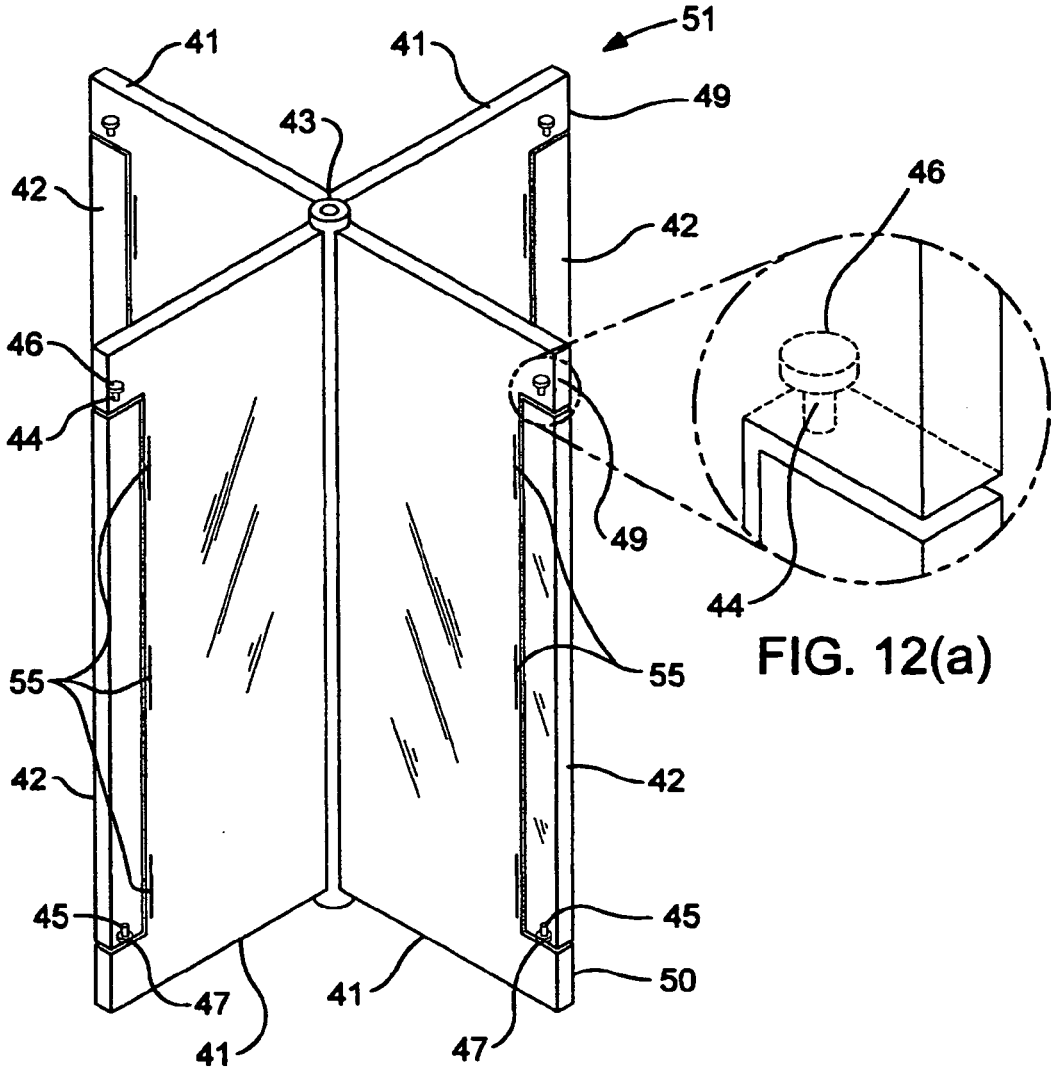
FIG. 12 illustrates an embodiment of the leaf door concept in which all four wings of a revolving door are equipped with integral spring-actuated leaf doors.

In FIG. 12, a commercial application of this invention is shown wherein each of the four wings 41, of a revolving door 51 is designed to function utilizing the leaf door concept. This embodiment of the safety door design is particularly applicable to public or commercial buildings equipped with revolving doors. As shown in FIG. 12, each of the wings 41 is attached to a common door shaft 43. The door shaft 43 may be electrically or mechanically powered to simultaneously rotate the wings, normally counter-clockwise, in response to pedestrian traffic moving through the door.

Each wing 41 contains a leaf door 42, which may pivot, by means of an upper dowel 44 and a lower dowel 45 embedded in the respective leaf door 42, about an axis running concentrically through each paired upper and lower dowel 44, 45. Each upper dowel 44 is contained in an upper circular metallic notch 46 and each lower dowel 45 rests in a lower circular metallic notch 47. The circular notches are built into the respective upper ledge 49 and lower ledge 50, with each ledge being an integral part of the structure of each wing 41.

A plurality of spring-loading devices 48 are regularly spaced along the junction of each leaf door 42, and its respective wing 41. The spring-loading devices 48 assist in moderating the closing force of their respective leaf doors 42 in the event an obstruction is encountered during closing of the revolving door 51. Each leaf door 42 is generally 75% to 90% of the height of its respective wing 41.

Having described the basic and the enhanced embodiments of the door assembly inventive concept, it is believed that other modifications, improvements, and changes will be suggested to those skilled in the art in view of the teachings set forth herein. It is therefore to be understood that all such variations, improvements, and changes are encompassed within the scope of the present invention.

What is claimed is:

1. A segmented door and corresponding doorframe assembly of physical dimensions, comprising (a) a main door, being a rectangular planar structure having, sequentially, a top surface, a convex trailing edge, a bottom surface, and a leading edge;

(b) a rectangular cutout formed by the excision of approximately the lower half of the leading edge of said main door, said cutout having a horizontal segment and a vertical segment oriented parallel to the main door leading edge;

(c) a rectangular leaf door of dimensions corresponding to the dimensions of said cutout, said leaf door further having, sequentially, a top surface, a trailing edge, a bottom surface, and a leading edge, (d) a doorframe having interior dimensions corresponding to the exterior outer perimetral dimensions of said main door, further having, sequentially, an inner top surface, an outer top surface, a concave inner rear surface, an outer rear surface, a top threshold, a bottom threshold, an inner front surface, and an outer front surface;

(e) a means for pivotally attaching and abutting the convex trailing edge of said main door against the concave inner rear surface of said doorframe, thereby forming a major pivotal means;

(f) a spring-loaded means for pivotally attaching the leaf door within said cutout such that the trailing edge of said leaf door abuts the vertical segment of said cutout, thereby forming a minor pivotal means;

(g) a means for periodically latching the leading edge of said main door to the inner front member of said doorframe;

(h) a means for latching the top surface and bottom surface of said main door to the inner top surface and the threshold of said doorframe, respectively; and (i) a means for periodically latching the bottom of said leaf door to the threshold of said doorframe; wherein said spring-loaded means for pivotally attaching the leaf door further comprises directional spring loading in a manner such as to retain the leaf door flush in the same plane as the main door during static fully open or fully closed conditions of the main door and, upon closing of the main door and simultaneously encountering a firm object between the leaf door and said doorframe inner front surface, such as to provide an inhibition of the full closing and abutment of said leaf door against said doorframe.

2. A segmented door and corresponding doorframe assembly of physical dimensions comprising (a) a main door, being a rectangular planar structure having, sequentially, a top surface, a convex trailing, edge, a bottom surface, a leading edge, an upper main spindle integral and perpendicular to the top surface of said main door, said spindle further having an axis concentric with the center of the curvature of said convex trailing edge, and a lower main spindle integral and perpendicular to the bottom surface of said main door, said spindle further having an axis concentric with the center of the curvature of said convex trailing edge;

(b) a rectangular cutout formed by the excision of approximately the lower half of the leading edge of said main door, said cutout having a horizontal segment and a vertical segment oriented parallel to the main door leading edge;

(c) a rectangular leaf door of dimensions corresponding to the dimensions of said cutout, said leaf door further having, sequentially, a top surface, a trailing edge, a bottom surface, a leading edge, an upper dowel integral and perpendicular to the top surface of said leaf door, said upper dowel further having an axis parallel to and proximate the trailing edge;

(d) a doorframe having interior dimensions corresponding to the exterior height and width dimensions of said main door, further having, sequentially, an inner top surface, an outer top surface, a concave inner roar surface, an outer rear surface, a top threshold, a bottom threshold, an inner front surface, an outer front surface, a circular upper housing integral to the inner top surface proximate the inner rear surface of said doorframe, and a circular lower housing integral to the top threshold proximate the inner rear surface of said doorframe, said circular upper housing and circular lower housing containing an upper ball bearing assembly and co-axially, a lower ball bearing assembly, respectively;

(e) a spring-loaded means for pivotally attaching the leaf door within said cutout such that the trailing edge of said leaf door abuts the vertical segment of said cutout, thereby forming a minor pivotal means;

(f) a means for periodically latching the leading edge of said main door to the inner front member of said doorframe;

(g) a means for latching the top surface and bottom surface of said main door to the inner top surface and the threshold of said doorframe, respectively;

(h) a means for periodically latching the bottom of said leaf door to the threshold of said doorframe; wherein said spring-loaded means for pivotally attaching the leaf door further comprises directional spring loading in a manner such as to retain the leaf door flush in the same plane as the main door during static conditions and, upon closing of the main door and simultaneously encountering a firm object between the leading, edge of said leaf door and said doorframe inner front surface, and such as to provide an inhibition of the full closing and abutment of said leaf door against said doorframe.

3. A segmented door and corresponding doorframe assembly of physical dimensions comprising (a) a main door, being a rectangular planar structure having, sequentially, a top surface, a convex trailing edge, a bottom surface, a leading edge, an upper main spindle integral and perpendicular to the top surface of said main door, said spindle further having an axis concentric with the center of the curvature of said convex trailing edge; and a lower main spindle integral and perpendicular to the bottom surface of said main door, said spindle further having an axis concentric with the center of the curvature of said convex trailing edge, thereby forming a major pivotal means;

(b) a rectangular cutout formed by the excision of approximately the lower half of the leading edge of said main door, said cutout having a vertical segment, a horizontal upper reinforced ledge with an upper circular notch therein proximate said vertical segment, and a horizontal lower reinforced ledge with a lower circular notch therein, co-axial with said upper circular notch;

(c) a rectangular leaf door of dimensions corresponding to the dimensions of said cutout, said leaf door further having, sequentially, a top surface, a trailing, edge, a bottom surface, a leading edge, an upper dowel integral and perpendicular to the top surface of said leaf door, said upper dowel further having an axis parallel to and proximate the trailing edge, and a lower dowel integral and perpendicular to the lower surface of said leaf door, said lower dowel being coaxial with said upper dowel, thereby forming a minor pivotal means;

(d) a doorframe having interior dimensions corresponding to the exterior height and width dimensions of said main door and having, sequentially, an inner top surface, an outer top surface, a concave inner rear surface, an outer rear surface, a top threshold, a bottom threshold, an inner front surface, an outer front surface, a circular upper housing integral to the inner top surface proximate the inner rear surface of said doorframe a circular lower housing integral to the top threshold proximate the inner rear surface of said doorframe, said circular upper housing and circular lower housing containing an upper ball bearing assembly and co-axially, a lower ball bearing assembly, respectively;

(e) a spring-loaded means for retention of the leaf door flush with the plane of said main door during static fully closed or fully open conditions of said main door;

(f) a means for periodically latching the leading edge of said main door to the inner front member of said doorframe;

(g) a means for latching the top surface and bottom surface of said main door to the inner top surface and the threshold of said doorframe, respectively;

(h) a means for periodically latching the bottom of said leaf door to the threshold of said doorframe; and (i) a means for periodically latching the top of said leaf door to the horizontal segment of said cutout; wherein the trailing edge of said leaf door pivotally abuts the vertical segment of said cutout by virtue of said upper dowel enclosed within the upper circular notch of said cutout and said lower dowel enclosed within the lower circular notch of said cutout; and further, said spring-loaded means for retention of the leaf door further comprises directional spring loading in a manner such that, upon closing of the main door and simultaneously encountering a firm object between the leaf door and said doorframe inner front surface, said spring loading means provides a momentary inhibition of the full closing and abutment of said leaf door against said doorframe.

4. A door and doorframe assembly as in any one of claims 1, 2, or 3 wherein said means for vertical, pivotal attachment of the trailing edge of said leaf door to the vertical segment of said cutout comprises a spring mechanism, and further, said leaf door when closed, is held in an essentially flush orientation with said main door by the inherent tension of said spring mechanism.

5. A door and doorframe assembly in claim 1, wherein a) said major pivotal means comprises i) an upper rod inserted vertically downward into the top surface of said major door proximate and parallel to the trailing edge of said major door; and ii) a lower rod inserted upward into the bottom surface of said major door proximate and parallel to the trailing edge of said major door, said upper rod and lower rod being co-axial; and b) said doorframe further comprises i) an upper bearing assembly for reception of said upper rod, said upper bearing assembly integral to the inner top surface of said doorframe proximate the junction of the inner top surface and the inner rear surface of said doorframe, and (ii) a lower bearing assembly for reception of said lower rod, said lower bearing assembly being integral to said top threshold surface, proximate the junction of the top threshold surface and the inner rear surface of said doorframe.

6. A door and doorframe assembly as in any one of claims 1, 2, or 3, wherein said means for vertical, pivotal attachment of the trailing edge of said leaf door is selected from a group consisting of (a) upper and lower coaxial dowels, (b) upper and lower coaxial pins, and (c) an axle extending greater than the length of the trailing edge of said leaf door.

7. A door and doorframe assembly as in either of claim 1 or 2, wherein said rectangular cutout further comprises an upper circular notch embedded in said horizontal segment therein-a lower horizontal ledge with a lower circular notch embedded therein, co-axial with said upper circular notch; and further, said means for vertical, pivotal attachment of the trailing edge of said leaf door comprises, i) an upper dowel affixed to the top of the trailing edge of said leaf door, ii) a lower dowel affixed to the bottom of the trailing edge of said leaf door, said upper and lower dowels being co-axial with said upper and lower circular notches, and iii) at least one spring mechanism connecting the trailing edge of said leaf door to the vertical segment of said cutout.

8. A door and doorframe assembly as in any one of claim 1, 2, or 3, wherein (a) said doorframe further comprises an elastomeric material affixed along the length of the inner rear surface of said doorframe and (b) a hard rubber, plastic, or similar material having lengthwise parallel grooves is affixed to both the width of the doorframe top threshold and to the width of the bottom surface of the main door.

9. A segmented door and corresponding doorframe assembly as in any one of claim 1, 2, or 3, wherein said means for periodically latching the bottom of said leaf door to the threshold of said doorframe; and said means for periodically latching the top of said leaf door to the horizontal segment comprises a lower security rod enclosed within a vertically-oriented metal tube, said metal tube integral to the mid-interior of said leaf door;

a retraction coil spring affixed to the exterior surface of said lower security rod;

a lower strike box embedded within the top threshold of said doorframe;

an upper security rod enclosed within a vertically-oriented metal tube within said main door, the metal tube extending from the horizontal segment of said cutout to the top surface of said main door;

an upper strike box embedded within the inner top surface of said doorframe;

a latching deadbolt embedded proximate the leading edge of said main door, said deadbolt directly connected to a left mechanical linkage, and a right mechanical linkage, wherein said left mechanical linkage is attached to the lower end of said upper security rod and said right mechanical linkage is attached to the upper end of said retraction coil spring; wherein operation of said latching deadbolt effects the engagement and disengagement of said lower security rod and upper security rod with the lower strike box and said upper strike box, respectively.

10. A segmented door and corresponding doorframe assembly as in any one of claim 1, 2, or 3 wherein said means for latching the top surface of said main door to the inner top surface of said doorframe further comprises a main latching rod enclosed within a vertically-oriented metal tube, said metal tube within the main door proximate the leading edge of said main door;

a doorknob integral to the main door proximate mid-length of the leading edge, said doorknob being mechanically attached to the lower end of the main latching rod;

an upper strike plate embedded within the inner top surface of said door frame; wherein said main latching rod, upon closing of the main door, engages the upper strike plate and retains the main door in the closed position, wherein the main door may be opened by first rotating the doorknob so as to disengage the main latching rod from the upper strike plate.

11. A segmented door and corresponding doorframe assembly as in any one of claim 1, 2, or 3 wherein (a) said main door comprises a planar rectangular structure having dimensions of height in the range of seventy-eight inches to ninety-six inches (78.0"-96.0"), width in the range of twenty inches to thirty-six inches (20.0"-36.0"), depth in the range of one inch to three inches (1.0"-3.0"), said having a horizontal segment in the range of three inches to six inches (3.0"-6.0") and said vertical segment in the range of thirty-six inches to sixty inches (36.0"-60.0"), said main door further comprising a height-to-width ratio of approximately 3:1; and (b) said doorframe comprises a height-to-width ratio of approximately 3:1, and further, said doorframe comprises inner perimetral dimensions corresponding to the exterior perimetral height and width dimensions of said main door.

12. A segmented door and corresponding doorframe assembly as in any one of claim 1, 2, or 3 wherein said spring-loaded means comprises at least one spring mechanism connected proximate the trailing edge of said leaf door and the vertical segment of the cutout of said main door, said spring mechanism selected from the group consisting of a u-spring, a plate spring, a coil spring, and a helical torsion spring.

* * * * *